US010227202B2

(12) United States Patent
Pamperin et al.

(10) Patent No.: US 10,227,202 B2
(45) Date of Patent: Mar. 12, 2019

(54) METHOD AND SYSTEM FOR CUTTING AND PLACING NOSE WIRES IN A FACEMASK MANUFACTURING PROCESS

(71) Applicant: O&M Halyard, Inc., Mechanicsville, VA (US)

(72) Inventors: Mark Thomas Pamperin, Cumming, GA (US); Nathan Craig Harris, Canton, GA (US); Joseph P. Weber, Suwanee, GA (US); Ajay Y. Houde, Duluth, GA (US); David Lamar Harrington, Cumming, GA (US)

(73) Assignee: O&M Halyard, Inc., Mechanicsville, VA (US)

( * ) Notice: Subject to any disclaimer, the term of this patent is extended or adjusted under 35 U.S.C. 154(b) by 0 days.

(21) Appl. No.: 15/307,448

(22) PCT Filed: Oct. 16, 2015

(86) PCT No.: PCT/US2015/055871
§ 371 (c)(1),
(2) Date: Oct. 28, 2016

(87) PCT Pub. No.: WO2017/065790
PCT Pub. Date: Apr. 20, 2017

(65) Prior Publication Data
US 2018/0208426 A1 Jul. 26, 2018

(51) Int. Cl.
*B65H 49/18* (2006.01)
*A41D 13/11* (2006.01)
(Continued)

(52) U.S. Cl.
CPC ..... *B65H 49/18* (2013.01); *A41D 13/11* (2013.01); *B65H 51/20* (2013.01); *B65H 51/30* (2013.01); *A62B 18/02* (2013.01); *A62B 23/025* (2013.01)

(58) Field of Classification Search
CPC .. A41H 42/00; A62B 23/025; A61M 2207/00; A61M 2207/10
See application file for complete search history.

(56) References Cited

U.S. PATENT DOCUMENTS 3,629,039 A * 12/1971 Frick ..... A61F 13/15674 156/269
3,670,474 A 6/1972 Vieson et al.
(Continued)

FOREIGN PATENT DOCUMENTS

CA 2 325 975 A1 5/2002
CN 104872866 A 9/2015
(Continued)

OTHER PUBLICATIONS

Machine translation of KR 100550225 B1.*
(Continued)

*Primary Examiner* — (Jackie) Tan-Uyen T Ho
*Assistant Examiner* — Joseph D Boecker
(74) *Attorney, Agent, or Firm* — Dority & Manning, P.A.

(57) ABSTRACT

A method and associated system are provided for cutting and placing individual nose wires in a facemask production line. A continuous wire is supplied from a supply source to a cutting station in the facemask production line where the continuous wire is cut into individual nose wires having a defined length. A first web is conveyed to a vacuum conveyor, and the individual nose wires are deposited from the cutting station onto the vacuum conveyor such that the nose wires are drawn by vacuum against the first web at a defined spacing and orientation. With the vacuum conveyor, the first web and attached nose wires are conveyed to a folding station wherein the first web and nose wires are combined with a second web such that the nose wires are encapsulated between the first and second webs.

11 Claims, 4 Drawing Sheets

(51) Int. Cl.

| | |
|---|---|
| ***B65H 51/20*** | (2006.01) |
| ***B65H 51/30*** | (2006.01) |
| *A62B 18/02* | (2006.01) |
| *A62B 23/02* | (2006.01) |

(56) References Cited

U.S. PATENT DOCUMENTS

| | | | | |
|---|---|---|---|---|
| 3,847,046 | A | 11/1974 | Schmermund | |
| 3,983,774 | A | 10/1976 | Seragnoli | |
| 5,117,614 | A | 6/1992 | Johnsen | |
| 5,155,967 | A | 10/1992 | Branson | |
| 5,170,610 | A | 12/1992 | Tisma | |
| 5,322,061 | A | 6/1994 | Brunson | |
| 5,724,677 | A * | 3/1998 | Bryant | A41D 13/1146 2/206 |
| 5,727,369 | A | 3/1998 | Mosse | |
| 6,123,077 | A * | 9/2000 | Bostock | A41D 13/11 128/206.12 |
| 6,125,849 | A * | 10/2000 | Williams | A62B 23/025 128/206.12 |
| 6,173,712 | B1 | 1/2001 | Brunson | |
| 6,174,397 | B1 | 1/2001 | Johnson | |
| 6,524,423 | B1 * | 2/2003 | Hilt | B65C 1/02 156/265 |
| 6,729,103 | B1 | 5/2004 | Hartness et al. | |
| 7,703,260 | B1 | 4/2010 | Watkins | |
| 2001/0029952 | A1 * | 10/2001 | Curran | A62B 18/10 128/206.17 |
| 2002/0095913 | A1 | 7/2002 | Honegger | |
| 2004/0019400 | A1 * | 1/2004 | Popp | A61F 13/15772 700/125 |
| 2004/0144619 | A1 | 7/2004 | Ohiro et al. | |
| 2004/0262127 | A1 | 12/2004 | Harnish et al. | |
| 2006/0070353 | A1 | 4/2006 | Van Dam | |
| 2008/0011303 | A1 * | 1/2008 | Angadjivand | A41D 13/113 128/206.19 |
| 2008/0072721 | A1 | 3/2008 | Kern | |
| 2008/0251210 | A1 | 10/2008 | Chen | |
| 2008/0251214 | A1 * | 10/2008 | Chen | A41D 13/11 156/580.2 |
| 2009/0094941 | A1 * | 4/2009 | Burns, Jr. | A61F 13/15747 53/429 |
| 2011/0055998 | A1 * | 3/2011 | Tai | A41D 13/1115 2/173 |
| 2012/0152695 | A1 * | 6/2012 | Coenen | B65H 45/16 198/617 |
| 2015/0158672 | A1 * | 6/2015 | Lenser | B65G 23/06 198/617 |
| 2015/0173436 | A1 * | 6/2015 | Tsuei | A62B 7/10 2/424 |

FOREIGN PATENT DOCUMENTS

| | | | | |
|---|---|---|---|---|
| CN | 104939377 | A | 9/2015 | |
| DE | 3736868 | A1 | 5/1989 | |
| EP | 0 622 298 | A1 | 11/1994 | |
| EP | 0 640 526 | A1 | 3/1995 | |
| EP | 0 791 537 | A1 | 8/1997 | |
| EP | 0 806 343 | A2 | 11/1997 | |
| EP | 0 894 752 | A1 | 2/1999 | |
| EP | 1 048 595 | A1 | 11/2000 | |
| EP | 2 484 611 | A2 | 8/2012 | |
| EP | 2 801 790 | A1 | 11/2014 | |
| FR | 1588621 | A | 4/1970 | |
| GB | 364557 | | 12/1931 | |
| GB | 2 092 090 | A | 8/1982 | |
| JP | 2011-178459 | A | 9/2011 | |
| JP | 2012217651 | A * | 11/2012 | A62B 23/025 |
| KR | 100550225 | | 2/2006 | |
| KR | 100550225 | B1 * | 2/2006 | A62B 18/08 |
| WO | WO 97/32494 | | 9/1997 | |
| WO | WO 2013007221 | A1 * | 1/2013 | A62B 23/025 |

OTHER PUBLICATIONS

Machine translation of JP 2012217651 A.*

"U.S. Backs High-Speed Manufacturing of Masks for Pandemics"; retrieved from https://globalbiodefense.com/2015/12/10/u-s-backs-high-speed-manufacturing-of-masks-for-pandemics/; Dec. 10, 2015.*

International Search Report and Written Opinion, dated Jun. 2, 2016, 11 pages.

* cited by examiner

-Prior Art-

-Prior Art-

-Prior Art-

METHOD AND SYSTEM FOR CUTTING AND PLACING NOSE WIRES IN A FACEMASK MANUFACTURING PROCESS

FIELD OF THE INVENTION

The present invention relates generally to the field of protective facemasks, and more specifically to a method and system for cutting and placing nose wires in the manufacturing of such facemasks.

FAMILY OF RELATED APPLICATIONS

The present application is related by subject matter to the following concurrently filed PCT applications (all of which designate the US):

a. International Application No.: PCT/US2015/055858; entitled "Method and System for Splicing Nose Wire in a Facemask Manufacturing Process".

b. International Application No.: PCT/US2015/055861; entitled "Method and System for Splicing Nose Wire in a Facemask Manufacturing Process".

c. International Application No.: PCT/US2015/055863; entitled "Method and System for Introducing a Reserve Nose Wire in a Facemask Production Line".

d. International Application No.: PCT/US2015/055865; entitled "Method and System for Cutting and Placing Nose Wires in a Facemask Manufacturing Process".

e. International Application No.: PCT/US2015/055867; entitled "Method and System for Placing Nose Wires in a Facemask Manufacturing Process".

f. International Application No.: PCT/US2015/055872; entitled "Method and System for Placing Nose Wires in a Facemask Manufacturing Process".

g. International Application No.: PCT/US2015/055876; entitled "Method and System for Wrapping and Preparing Facemasks for Packaging in a Facemask Manufacturing Line".

h. International Application No.: PCT/US2015/055878; entitled "Method and System for Automated Stacking and Loading Wrapped Facemasks into a Carton in a Facemask Manufacturing Line".

i. International Application No.: PCT/US2015/055882; entitled "Method and System for Automated Stacking and Loading of Wrapped Facemasks into a Carton in a Facemask Manufacturing Line".

The above cited applications are incorporated herein by reference for all purposes. Any combination of the features and aspects of the subject matter described in the cited applications may be combined with embodiments of the present application to yield still further embodiments of the present invention.

BACKGROUND OF THE INVENTION

Various configurations of disposable filtering facemasks or respirators are known and may be referred to by various names, including "facemasks", "respirators", "filtering face respirators", and so forth. For purposes of this disclosure, such devices are referred to generically as "facemasks."

The ability to supply aid workers, rescue personnel, and the general populace with protective facemasks during times of natural disasters or other catastrophic events is crucial. For example, in the event of a pandemic, the use of facemasks that offer filtered breathing is a key aspect of the response and recovery to such event. For this reason, governments and other municipalities generally maintain a ready stockpile of the facemasks for immediate emergency use. However, the facemasks have a defined shelf life, and the stockpile must be continuously monitored for expiration and replenishing. This is an extremely expensive undertaking.

Recently, investigation has been initiated into whether or not it would be feasible to mass produce facemasks on an "as needed" basis during pandemics or other disasters instead of relying on stockpiles. For example, in 2013, the Biomedical Advanced Research and Development Authority (BARDA) within the Office of the Assistant Secretary for Preparedness and Response in the U.S. Department of Health and Human Services estimated that up to 100 million facemasks would be needed during a pandemic situation in the U.S., and proposed research into whether this demand could be met by mass production of from 1.5 to 2 million facemasks per day to avoid stockpiling. This translates to about 1,500 masks/minute. Current facemask production lines are capable of producing only about 100 masks/minute due to technology and equipment restraints, which falls far short of the estimated goal. Accordingly, advancements in the manufacturing and production processes will be needed if the goal of "on demand" facemasks during a pandemic is to become a reality.

The various configurations of filtration facemasks include a flexible, malleable metal piece, known as "nose wire", along the edge of the upper filtration panel to help conform the facemask to the user's nose and retain the facemask in place during use, as is well known. The nose wire may have a varying length and width between different sizes and mask configurations, but is generally cut from a spool in a continuous in-line process and laid onto a running carrier nonwoven web (which may include a plurality of nonwoven layers) along an edge that becomes a top edge of the finished mask. The edge is subsequently sealed with a binder material, which also encapsulates and permanently holds the nose wire in place at the top edge. However, prior to this encapsulation, the nose wire is not otherwise positively held to the carrier web. For mass production of facemasks at the throughputs mentioned above, the carrier web will necessarily move at a significantly greater transport speed as compared to conventional manufacturing lines. Consequently, it is believed that the nose wires will need to be positively held on the carrier web to ensure proper placement of the nose wires prior to the encapsulation process.

The present invention addresses this need and provides a method and associated system for high speed cutting and placement of nose wires on the running carrier web in an in-line manufacturing process of facemasks.

SUMMARY OF THE INVENTION

Objects and advantages of the invention will be set forth in the following description, or may be obvious from the description, or may be learned through practice of the invention.

In accordance with aspects of the invention, a method and system are provided for cutting and placing individual nose wires in a facemask production line. A continuous wire is supplied from a source, such a roll of the wire, to a cutting station in the facemask production line. At the cutting station, the continuous wire is cut into individual nose wires having a defined length. A first web is conveyed to a vacuum conveyor, and the individual nose wires from the cutting station are also conveyed to the vacuum conveyor such that the nose wires are drawn by vacuum against the first web at a defined spacing and placement. An adhesive may be applied to the first web prior to placement of the nose wires on the web. With the vacuum conveyor, the first web and attached nose wires are moved to a folding station wherein the first web with attached nose wires are combined with a second web such that the nose wires are encapsulated between the webs.

The method may also include conveying the webs and encapsulated nose wires to a bonding station where the webs are bonded together.

Various types of vacuum conveyors may be used. For example, in one embodiment, the vacuum conveyor is a rotary wheel conveyor that draws the nose wires radially inward against the first web as the rotary wheel conveyor rotates.

In an alternative embodiment, the vacuum conveyor is a linear web conveyor that draws the nose wires against the first web.

In a particular embodiment, the first web is a carrier web that forms an upper panel portion of the facemasks produced in the production line, and the second web is a binder web that is folded over an edge of the carrier web with the nose wires encapsulated between the carrier web and the binder web. Thus, in this embodiment, the nose wires are drawn by vacuum against the carrier web, and the binder web is brought to the carrier web and attached nose wires.

In an alternative embodiment, the first web is the binder web and the nose wires are drawn by vacuum against the binder web. The second web is the carrier web that forms an upper panel portion of facemasks produced in the production line. The carrier web is brought to the binder web at the folding station, wherein the binder web is folded over an edge of the carrier web with the nose wires encapsulated between the carrier web and the binder web.

The present invention also encompasses various system embodiments for cutting and placing individual nose wires in a facemask production line in accordance with the present methods, as described and supported herein.

Other features and aspects of the present invention are discussed in greater detail below.

BRIEF DESCRIPTION OF THE DRAWINGS

A full and enabling disclosure of the present invention, including the best mode thereof, directed to one of ordinary skill in the art, is set forth more particularly in the remainder of the specification, which makes reference to the appended figures in which.

DETAILED DESCRIPTION OF REPRESENTATIVE EMBODIMENTS

Reference now will be made in detail to various embodiments of the invention, one or more examples of which are set forth below. Each example is provided by way of explanation of the invention, not limitation of the invention. In fact, it will be apparent to those skilled in the art that various modifications and variations may be made in the present invention without departing from the scope or spirit of the invention. For instance, features illustrated or described as part of one embodiment, may be used on another embodiment to yield a still further embodiment. Thus, it is intended that the present invention covers such modifications and variations as come within the scope of the appended claims and their equivalents.

As mentioned, the present methods and systems relate to cutting and placement of individual nose wires in a facemask production line. The downstream facemask production steps are not limiting aspects of the invention and, thus, will not be explained in great detail herein.

Also, the present disclosure refers to or implies conveyance or transport of certain components of the facemasks through the production line. It should be readily appreciated that any manner and combination of article conveyors (e.g., rotary and linear conveyors), article placers (e.g. vacuum puck placers), and transfer devices are well known in the article conveying industry and can be used for the purposes described herein. It is not necessary for an understanding and appreciation of the present methods to provide a detailed explanation of these well-known devices and system.

Various styles and configurations of facemasks that incorporate a nose wire are well known, including flat pleated facemasks, and the present methods may have utility in the production lines for these conventional masks. For illustrative purposes only, aspects of the present method are described herein with reference to a particular type of respirator facemask often referred to in the art as a "duckbill" mask, as illustrated in FIG. 1.

Figure 1:
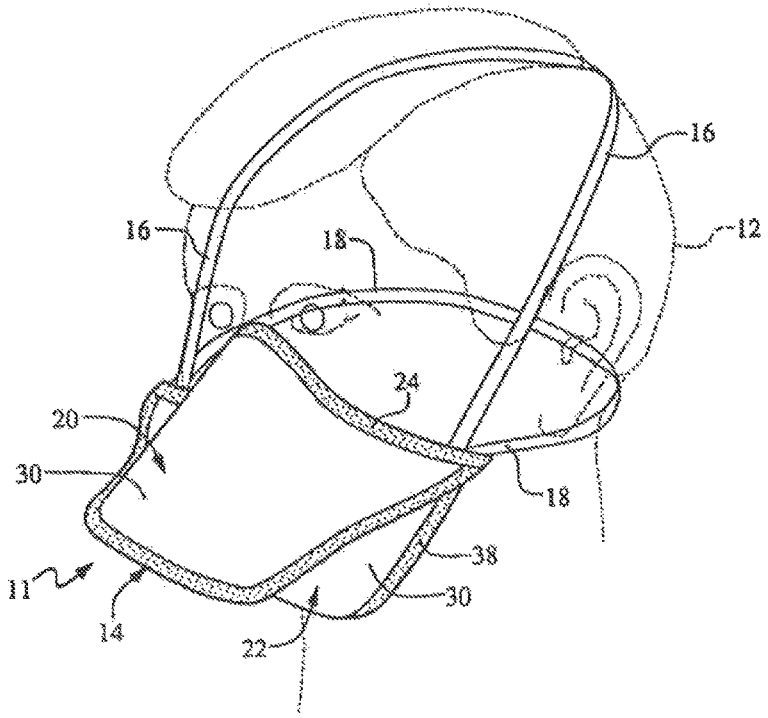
FIG. 1 is a perspective view of a conventional respiratory facemask worn by a user, the facemask incorporating a nose wire to conform the facemask to the user's face.
Figure 2:
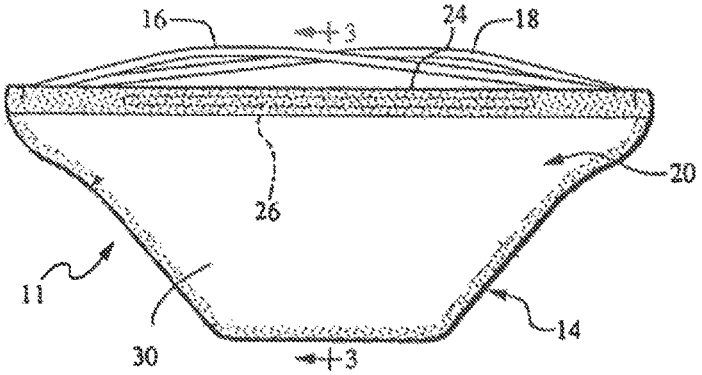
FIG. 2 is a top view of the conventional facemask of FIG. 1 is a folded state.
Figure 3:
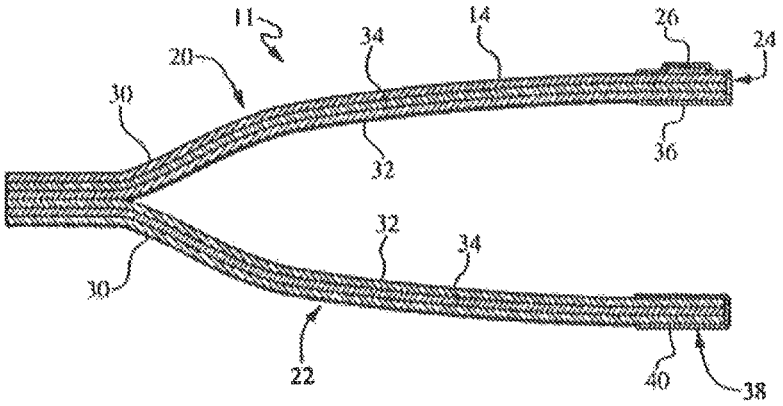
FIG. 3 is a cross-sectional view of the facemask of FIG. 2 taken along the lines indicated in FIG. 2.

Referring to FIGS. 1-3, a representative facemask 11 (e.g., a duckbill facemask) is illustrated on the face of wearer 12. The mask 11 includes filter body 14 that is secured to the wearer 12 by means of resilient and elastic straps or securing members 16 and 18. The filter body 14 includes an upper portion 20 and a lower portion 22, both of which have complimentary trapezoidal shapes and are preferably bonded together such as by heat and/or ultrasonic sealing along three sides. Bonding in this manner adds important structural integrity to mask 11.

The fourth side of the mask 11 is open and includes a top edge 24 and a bottom edge 38, which cooperate with each other to define the periphery of the mask 11 that contacts the wearer's face. The top edge 24 is arranged to receive an elongated malleable member 26 (FIGS. 2 and 3) in the form of a flat metal ribbon or wire (referred to herein as a "nose wire"). The nose wire 26 is provided so that top edge 24 of mask 11 can be configured to closely fit the contours of the nose and cheeks of wearer 12. The nose wire 26 is typically constructed from an aluminum strip with a rectangular cross-section. With the exception of having the nose wire 26 located along top edge 24 of the upper portion 20 of the mask 11, the upper and lower portions 20 and 22 may be identical.

As shown in FIG. 1, the mask 11 has the general shape of a cup or cone when placed on the face of wearer 12 and thus provides "off-the-face" benefits of a molded-cone style mask while still being easy for wearer 12 to carry mask 11 in a pocket prior to use. "Off-the-face" style masks provide a larger breathing chamber as compared to soft, pleated masks which contact a substantial portion of the wearer's face. Therefore, "off-the-face" masks permit cooler and easier breathing.

Blow-by associated with normal breathing of wearer 12 is substantially eliminated by properly selecting the dimension and location of the nose wire 26 with respect to top edge of 24. The nose wire 26 is preferably positioned in the center of top edge 24 and has a length in the range of fifty percent (50%) to seventy percent (70%) of the total length of the top edge 24.

As illustrated in cross-sectional view of FIG. 3, the upper and lower portions 20 and 22 may include multiple layers and each have an outer mask layer 30 and inner mask layer 32. Located between outer and inner mask layers 30, 32 is one or more intermediate layer 34 that comprises the filter media for the mask 11. This layer is typically constructed from a melt-blown polypropylene, extruded polycarbonate, melt-blown polyester, or a melt-blown urethane.

The top edge 24 of the mask 11 is faced with an edge binder 36 that extends across the open end of mask 11 and covers the nose wire 26. Similarly, the bottom edge 38 is encompassed by an edge binder 40. Edge binders 36 and 40 are folded over and bonded to the respective edges 24, 30 after placement of the nose wire 26 along the top edge 24. The edge binders 36, 40 may be constructed from a spun-laced polyester material.

Figure 4:
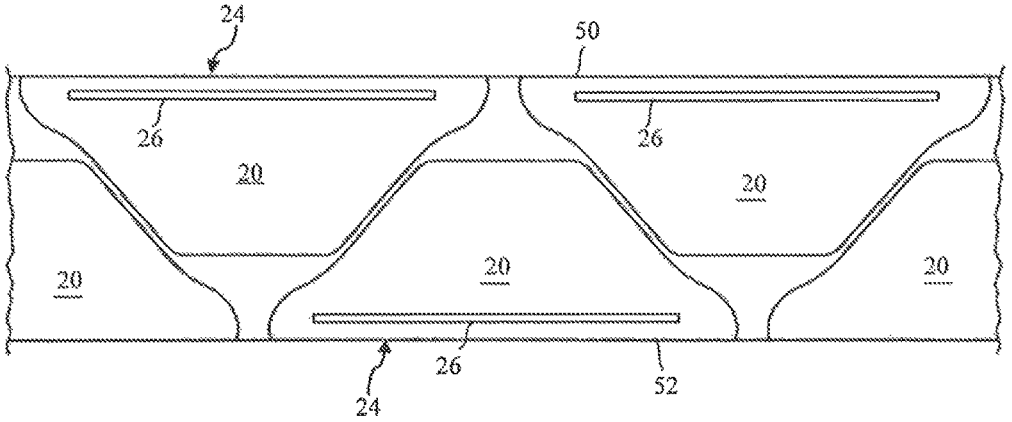
FIG. 4 is a top view of a web having a plurality of facemask panels defined therein, with a nose wire incorporated in edges of alternating panels in the web.

FIG. 4 illustrates the layout of the generally trapezoidal shape for cutting the layers forming the upper body portions 20. A similar layout would be produced for the lower body portion 22, which is then brought into alignment with and bonded to the upper body portion 20 in the facemask manufacturing line. More precisely, the layouts of FIG. 4 represent the outline of cutters which ultimately cut layers 30 and 32 for the upper portion 20 from respective flat sheets of material, with the layouts arranged in an alternating pattern on the flat sheets of material between edges 50, 52 representing the open side of mask 11 formed by top edge 24 and bottom edge 38. The arrangement of the layouts is such that a continuous piece of scrap may be formed as the material is fed through the cutter (not shown) utilized in making mask 11. FIG. 4 illustrates placement of cut nose wires 26 on the portions of the continuous web corresponding to the top edge 24 prior to folding and bonding of the edge binders 36, 40 along the edges 24, 38.

Figure 5:
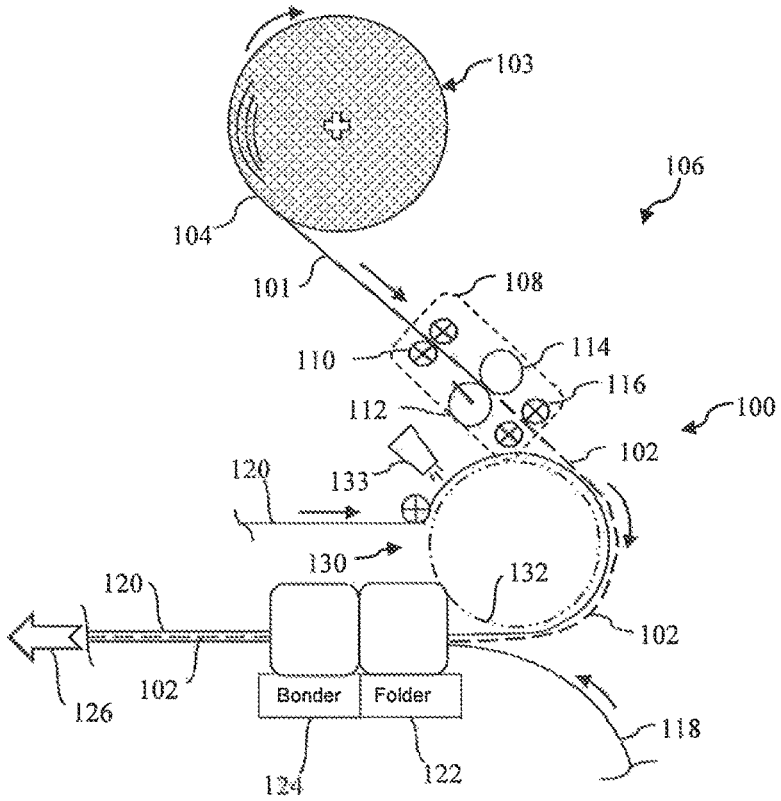
FIG. 5 is a schematic depiction of parts of a facemask production line in accordance with aspects of the invention related to cutting and placement of nose wires on a web by vacuum for subsequent incorporation with facemask panels.

FIG. 5 depicts portions of a production line 106 for facemasks that incorporate a nose wire 26 (FIG. 4) in accordance with aspects of the present method. A running wire 101 is supplied in continuous strip form from a source 103, such as a driven roll 104, to a cutting station 108. Suitable cutting stations 108 are known and used in conventional production lines. The station 108 may include a set of feed rollers 110 that define a driven nip, wherein one of the feed rollers is driven and the other may be an idler roll. The running wire 101 is fed to a cutter roller 112 configured opposite to an anvil 114 (which may be a stationary or rotary anvil), wherein the cuter roller 112 is driven at a rate so as to cut the running wire 101 into individual nose wires 102 having a defined length.

Still referring to FIG. 5, a first web 120 is conveyed to a vacuum conveyor 130 that is disposed relative to the cutting station 108 such that a pair of delivery rollers 116 downstream of the cutter roller 112 transport the individual nose wires 102 from the cutting station 108 onto the vacuum conveyor 130 such that the nose wires 102 are drawn by vacuum against the first web 120 at a defined spacing and placement. With the vacuum conveyor 130, the first web 120 and attached nose wires 102 are moved to a folding station 122 wherein the first web 120 with attached nose wires are combined with a second web 118 such that the nose wires 102 are encapsulated between the webs 118, 120.

As depicted in FIG. 5, it may be desired to apply an adhesive via a spray or coating device 133 onto the surface of the first web 120 that will be contacted by the nose wires 102 to ensure that the nose wires remain adhered to an in place relative to the first web 120 as they are transported to the folding station 122.

The webs 118, 120 and encapsulated nose wires may then be conveyed to a bonding station 124 where the webs 118, 120 are bonded together.

From the bonding station 124, the continuous combination of carrier web 118, nose wires 102, and binder web 120 is conveyed to further downstream processing stations 126 wherein the individual facemasks are cut, bonded, head straps are applied, and so forth.

In the embodiment depicted in FIG. 5, the first web is the binder web 120 discussed above, and the nose wires 102 are drawn by vacuum against the binder web 120 at a defined spacing and orientation for subsequent encapsulation along an edge of the second web, which is the carrier web 120 that forms an upper panel portion 20 of facemasks produced in the production line 106. The carrier web 118 is brought to the binder web 120 at the folding station 122, wherein the binder web 120 is folded over an edge of the carrier web 118 with the nose wires 102 encapsulated between the carrier web 118 and the binder web 120.

Various types of vacuum conveyors 130 may be used. For example, in the embodiment of FIG. 5, the vacuum conveyor 130 is a rotary wheel conveyor 132 connected to an internal vacuum source and having a surface that includes perforations or slits in a pattern that orients and spaces the nose wires 102. Because first web 120 (the binder web in the embodiment of FIG. 5) is permeable to air flow, the nose wires 102 are drawn radially inward against the first web 120 as the rotary wheel 132 conveyor rotates. The vacuum is applied internally along a circumferential section of the rotary wheel 132 such that the first web 120 and nose wires 102 release from the wheel at a defined position onto the second web 118 (the carrier web in the embodiment of FIG. 5) just prior to entering the folding station 122.

Figure 6:
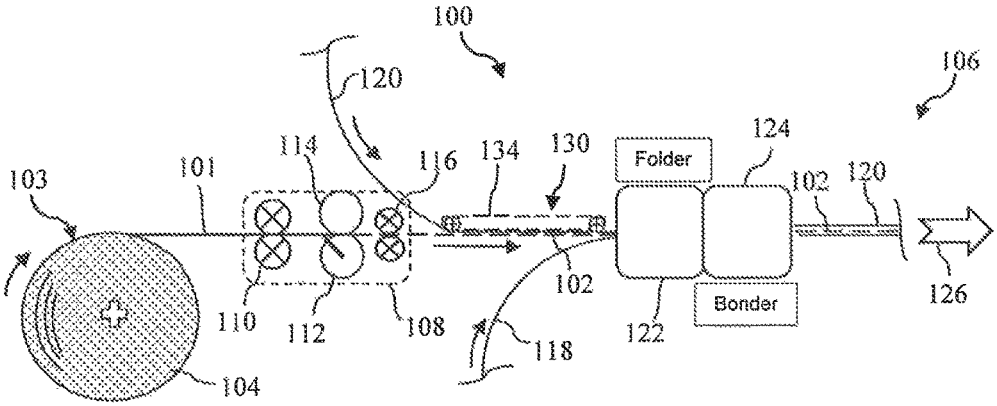
FIG. 6 is a schematic representation of an alternative embodiment for cutting and placement of nose wires on a web by vacuum in accordance with aspects of the invention.

FIG. 6 depicts an alternative embodiment, wherein the vacuum conveyor 130 is a linear web conveyor 134 operationally disposed between the cutting station 108 and the folding station 122. The binder web 120 is conveyed below the linear conveyor 134, and the nose wires 102 from the delivery rollers 116 are drawn upward against the binder web 120. The linear conveyor 134 and nose wires 102 are released onto the carrier web 118 as the components move into the folding station 122.

Figure 7:
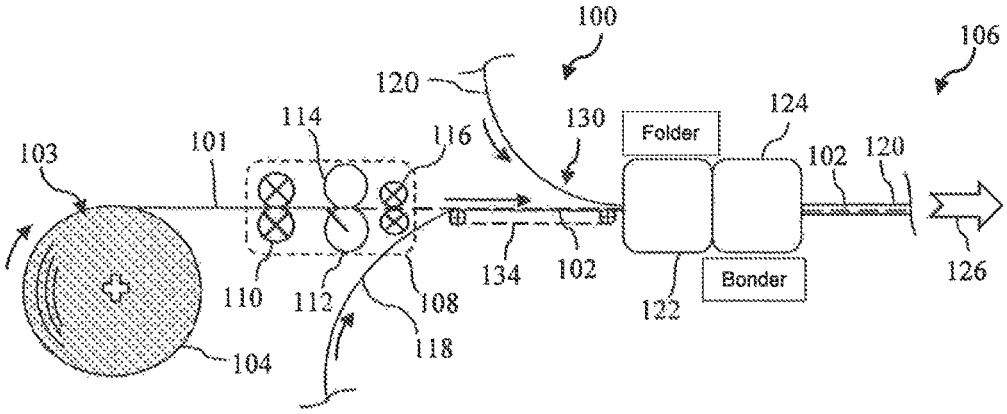
FIG. 7 is a schematic representation of still another embodiment for cutting and placement of nose wires on a web by vacuum in accordance with aspects of the invention.

In the embodiment depicted in FIG. 7, the first and second webs are switched. The first web is the carrier web 118 that forms the upper panel portion 20 of the facemasks produced in the production line 106, and the second web is the binder web 120 that is folded over an edge of the carrier web 118 with the nose wires 102 encapsulated between the carrier web 118 and the binder web 120. Thus, in this embodiment, the nose wires 102 are drawn by vacuum against the carrier web 118, and the binder web 120 is brought to the carrier web 118 and attached nose wires 102. Referring to FIG. 4, this carrier web 118 may be the continuous multi-layer web that defines the upper body portion 20 wherein the individual nose wires 26 are deposited along the edge of the carrier web 118 corresponding to the top edge 24. It should be appreciated that an additional cutting station and vacuum conveyor may be operationally disposed opposite to (and upstream or downstream) of the cutting station 108 for cutting and placing the nose wires on the opposite nested upper body portions 20 in the web depicted in FIG. 4. For the sake of ease of understanding only one such cutting station and vacuum are illustrated and described herein.

With reference to FIG. 5, in order to ensure a proper spacing between the individual nose wires 102, it may be beneficial to control the relative speed between the delivery rollers 116 and the vacuum conveyor 132 by controlling one or both of the drives of the rollers 116 and conveyor 132. For example, it may be desired to maintain the relative speed between the two at a minimum. Alternatively, the speed of the rotary conveyor 132 may be set to produce an increased gap between the nose wires 102, depending on the downstream processing requirements. Likewise, in FIGS. 6 and 7, the differential speed between the delivery rollers 116 and the linear vacuum conveyor 134 can be controlled for the same purposes.

As mentioned, the present invention also encompasses various system embodiments for cutting and placing individual nose wires in a facemask production line in accordance with the present methods. Aspects of such systems are illustrated in the figures, and described and supported above.

The material particularly shown and described above is not meant to be limiting, but instead serves to show and teach various exemplary implementations of the present subject matter. As set forth in the attached claims, the scope of the present invention includes both combinations and sub-combinations of various features discussed herein, along with such variations and modifications as would occur to a person of skill in the art.

What is claimed is:

1. A method for cutting and placing individual nose wires in a facemask production line, comprising:

supplying a continuous wire from a supply source to a cutting station in the facemask production line;

at the cutting station, cutting the continuous wire into individual nose wires having a defined length;

conveying a binder web to a vacuum conveyor;

conveying the individual nose wires from the cutting station to the vacuum conveyor such that the nose wires are drawn by vacuum against the binder web at a defined spacing; and with the vacuum conveyor, moving the binder web and attached nose wires to a folding station wherein the binder web with attached nose wires are folded over an edge of a carrier web such that the nose wires are encapsulated between the binder web and the carrier web.

2. The method as in claim 1, further comprising conveying the carrier web with attached binder web and nose wires to a bonding station where the binder web is bonded to the carrier web.

3. The method as in claim 1, wherein the vacuum conveyor is a rotary wheel conveyor that draws the nose wires radially inward against the binder web as the rotary wheel conveyor rotates.

4. The method as in claim 1, wherein the vacuum conveyor is a linear web conveyor that draws the nose wires against the binder web.

5. A system for cutting and placing individual nose wires in a facemask production line, wherein the system is specifically configured for practice of the method of claim 1.

6. A method for cutting and placing individual nose wires in a facemask production line, comprising:

supplying a continuous wire from a supply source to a cutting station in the facemask production line;

at the cutting station, cutting the continuous wire into individual nose wires having a defined length;

conveying a first web to a vacuum conveyor;

conveying the individual nose wires from the cutting station to the vacuum conveyor such that the nose wires are drawn by vacuum against the first web at a defined spacing; and with the vacuum conveyor, moving the first web and attached nose wires to a folding station wherein the first web with attached nose wires are combined with a second web such that the nose wires are encapsulated between the webs.

7. The method as in claim 6, further comprising conveying the webs and encapsulated nose wires to a bonding station where the webs are bonded together.

8. The method as in claim 6, wherein the vacuum conveyor is a rotary wheel conveyor that draws the nose wires radially inward against the first web as the rotary wheel conveyor rotates.

9. The method as in claim 6, wherein the vacuum conveyor is a linear web conveyor that draws the nose wires against the first web.

10. The method as in claim 6, wherein the first web is a carrier web that forms an upper panel portion of facemasks produced in the production line, and the second web is a binder web that is folded over an edge of the carrier web with the nose wires encapsulated between the carrier web and the binder web.

11. The method as in claim 6, wherein the second web is a carrier web that forms an upper panel portion of facemasks produced in the production line, and the first web is a binder web that is folded over an edge of the carrier web with the nose wires encapsulated between the carrier web and the binder web.

* * * * *